US008258465B2

(12) United States Patent
Matsui

(10) Patent No.: US 8,258,465 B2
(45) Date of Patent: Sep. 4, 2012

(54) MASS SPECTROMETRY APPARATUS

(75) Inventor: Mayumi Matsui, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 690 days.

(21) Appl. No.: 12/324,895

(22) Filed: Nov. 28, 2008

(65) Prior Publication Data

US 2010/0133428 A1 Jun. 3, 2010

(51) Int. Cl.
*H01J 49/26* (2006.01)

(52) U.S. Cl. ..... 250/287; 250/281; 250/282; 702/23; 702/24; 702/25; 702/27; 702/28

(58) Field of Classification Search ..... 250/281, 250/282, 287; 702/23, 24, 25, 27, 28
See application file for complete search history.

(56) References Cited

U.S. PATENT DOCUMENTS

2006/0284069 A1* 12/2006 Le Blanc ..... 250/282
2006/0289736 A1* 12/2006 Yamashita et al. ..... 250/282

OTHER PUBLICATIONS

"Liquid Chromatograph Mass Spectrometer Systems (LCMS-IT-TOF)", Shimadzu Corp., May 17, 2007, Internet URL: http://www.an.shimadzu.co.jp/products/lcms/it-tof.htm.
Iida, et al., "Application of LCMS-IT-TOF to Proteome Analysis", Shimadzu Review, vol. 63 [1 • 2], pp. 19 to 28, Shimadzu Review Editorial Board, Sep. 29, 2006.

* cited by examiner

*Primary Examiner* — David A Vanore
*Assistant Examiner* — Nicole Ippolito
(74) *Attorney, Agent, or Firm* — Sughrue Mion, PLLC

(57) ABSTRACT

A mass spectrometry apparatus configured to allow a user to designate an upper limit value UL together with a lower limit value, as a peak sorting condition. A data processing section is operable to determine whether respective peak intensities of a plurality of peaks appearing on a mass spectrum fall within an intensity range Ath defined by upper and lower limit values UL, LL, and exclude any peak out of the intensity range Ath. The remaining ions are selected as precursor ions, for example, in descending or ascending order of peak intensity so as to perform an $MS^2$ analysis. The upper limit UL is adequately set to allow the $MS^2$ analysis for a sample component with a low concentration, by priority, while avoiding a sample component exhibiting a high intensity and having no need for the $MS^2$ analysis.

4 Claims, 3 Drawing Sheets

MASS SPECTROMETRY APPARATUS

BACKGROUND OF THE INVENTION

1. Field of the Invention

The present invention relates to an $MS^n$ type mass spectrometry apparatus for selecting an ion having a specific mass as a precursor ion, inducing fragmentation of the ion, and mass-analyzing the resulting product ions, and more specifically to an $MS^n$ mass spectrometry apparatus having a function of automatically selecting a precursor ion based on an $MS^{n-1}$ spectrum acquired through an $MS^{n-1}$ analysis to perform an $MS^n$ analysis.

2. Description of the Related Art

In $MS^n$ type mass spectrometry apparatuses, there has been known one type having a function of sorting a peak meeting a condition which is input and set by a user in advance, from peaks appearing on a mass spectrum acquired through an $MS^1$ analysis, and automatically selecting an ion corresponding to the sorted peak as a precursor ion to perform an $MS^2$ analysis. For example, a liquid chromatography/mass spectrometry system (LCMS-IT-TOF produced by Shimadzu Corp.) as disclosed in the following Non-Patent Document 1 comprises an ion trap (IT) for temporarily holding ions to sort the ions according to mass and then inducing fragmentation, and a time-of-flight mass spectrometer (TOF-MS) for mass-analyzing ions expelled from the ion trap with high mass resolution and accuracy. The liquid chromatography/mass spectrometry system has an automatic $MS^n$ function of automatically sorting a peak meeting a given condition based on a mass spectrum acquired through an $MS^1$ analysis during an LCMS analysis, selecting an ion corresponding to the sorted peak as a precursor ion, inducing fragmentation of the precursor ion by the ion trap, and introducing various types of ions produced by the fragmentation into the TOF-MS to perform a mass analysis ($MS^2$ analysis).

Generally, a large number of unwanted noise peaks having low peak intensities, such as peaks derived from foreign substances, appear on a mass spectrum. Thus, in order to prevent erroneous selection of such peaks, the automatic selection of a precursor ion is performed after a processing of excluding any peak having a peak intensity less than a preset lower limit value of a signal intensity on an $MS^{n-1}$ spectrum. As the most common methodology for selecting a precursor ion, a technique of sorting peaks each having a peak intensity equal to or greater than a lower limit value in the above manner, and selecting ions corresponding to the sorted peaks as precursor ions in descending order of peak intensity is widely used (see the following Non-Patent Document 2).

However, the $MS^2$ analysis using the above technique has the following problem. In a liquid chromatography/mass spectrometry system, a liquid sample containing sample components temporally separated through a liquid chromatography column is introduced into an ionization section of a mass spectrometry apparatus to perform mass analysis, and thereby peaks derived from a plurality of sample components exhibiting contiguous elution times (contiguous retention times in the column) appear on one mass spectrum, i.e., on a mass spectrum acquired at a certain time point. Thus, as the number of sample components exhibiting contiguous elution times becomes larger, a larger number of peaks derived from the different sample components appear on one mass spectrum, and therefore the number of types (a mass range) of ions to be selected as precursor ions is increased (widened). In this situation, if an $MS^2$ analysis is performed while selecting such ions as precursor ions in descending order of peak intensity, it requires time before an ion exhibiting a relatively low peak intensity is subjected to the $MS^2$ analysis.

Particularly, in cases where a large number (i.e., 10 cycles) of $MS^2$ analyses are repeated for the same precursor ion to increase an S/N ratio of a mass spectrum, and acquired mass profiles are subjected to an integration processing to create an $MS^2$ spectrum, a time period required for the analysis per precursor ion becomes longer. Thus, it requires further time before an ion exhibiting a relatively low peak intensity is subjected as a precursor ion to the $MS^2$ analysis. Consequently, at a time when the $MS^2$ analysis becomes able to be performed for the ion exhibiting a relatively low peak intensity as a precursor ion, elution of the corresponding component from the column is likely to already be completed to preclude acquisition of a sufficient (credible) $MS^2$ spectrum for the component.

[Non-Patent Document 1] "Liquid Chromatograph Mass Spectrometer Systems (LCMS-IT-TOF)", [online], Shimadzu Corp., [retrieval date: May 17, 2007], Internet <URL: http://www.an.shimadzu.co.jp/products/lcms/it-tof.htm>

[Non-Patent Document 2] Iida, et al., "Application of LCMS-IT-TOF to Proteome Analysis", Shimadzu Review, Vol. 63 [1•2], pp. 19 to 28, Shimadzu Review Editorial Board, Sep. 29, 2006

SUMMARY OF THE INVENTION

In view of the above problem, it is an object of the present invention to provide a mass spectrometry apparatus capable of reliably performing an $MS^n$ analysis even for an ion exhibiting a relatively low peak intensity on a mass spectrum, i.e., reliably performing an $MS^n$ analysis while selecting the ion exhibiting a relatively low peak intensity as a precursor ion during a period where the component is still eluted off of a liquid chromatography column arranged in a preceding stage.

In order to achieve this object, according to a first aspect of the present invention, there is provided a mass spectrometry apparatus designed to determine one or more precursor ions based on an $MS^{n-1}$ spectral data acquired through an $MS^{n-1}$ analysis, and inducing fragmentation of the precursor ions to perform an $MS^n$ analysis (wherein n is an integer of 2 or more). The mass spectrometry apparatus comprises a) setting means for allowing a user to input and set an upper limit value and a lower limit value of a signal intensity on an $MS^{n-1}$ spectrum, or to directly input and set an intensity range having upper and lower thresholds of a signal intensity on an $MS^{n-1}$ spectrum, b) peak sorting means operable to sort a peak having a peak intensity which falls within an intensity range defined by the upper and lower limit values or the directly input/set intensity range, from a plurality of peaks appearing in an acquired $MS^{n-1}$ spectrum, and c) analysis control means operable to controllably allow an ion having a mass corresponding to the peak sorted by the peak sorting means to be selected as a precursor ion so as to perform the $MS^n$ analysis.

According to a second aspect of the present invention, there is provided a mass spectrometry apparatus designed to determine one or more precursor ions based on an $MS^{n-1}$ spectral data acquired through an $MS^{n-}$analysis, and inducing fragmentation of the precursor ions to perform an $MS^n$ analysis (wherein n is an integer of 2 or more). The mass spectrometry apparatus comprises a) setting means operable to allow a user to input and set at least a lower limit value of a signal intensity on an $MS^{n-1}$ spectrum, b) peak sorting means operable to sort a peak having a peak intensity equal to or greater than the lower limit value, from a plurality of peaks appearing in an acquired $MS^{n-1}$ spectrum, and c) analysis control means operable to controllably allow ions having respective masses corresponding to the peaks sorted by the peak sorting means to be selected as precursor ions in ascending order of peak intensity so as to perform the $MS^n$ analysis.

The mass spectrometry apparatus according to each of the first and second aspects of the present invention is particularly effective in cases where a type of sample component in a sample to be introduced therein will change over time. For example, the mass spectrometry apparatus is effective in cases where an MS ($MS^1$) analysis and an MS/MS ($MS^2$) analysis are performed while sequentially introducing sample components separated in temporal direction by a chromatography column, such as liquid chromatography column, into an ionization section thereof.

When n is a minimum integer, i.e., 2, the $MS^{n-1}$ analysis corresponds to an MS analysis involving no fragmentation, and the $MS^n$ analysis corresponds to an MS/MS analysis where a fragmentation operation is performed once.

The present invention will be more specifically described based on this example where n is 2. In the mass spectrometry apparatus according to the first aspect of the present invention, the setting means includes manual operation means, such as a keyboard or a mouse, and is operable to accept a user input, such as upper and lower limit values of the signal intensity, and set the user input for the peak sorting means. The peak sorting means is a part of a data processing function of processing mass spectral data, and operable to sort a peak having a peak intensity which falls within an intensity range defined by the upper and lower limit values, from a plurality of peaks appearing in an MS spectrum acquired through an actual measurement of a target sample. This makes it possible to exclude not only a low-intensity peak having a peak intensity less than the lower limit value but also a high-intensity peak having a peak intensity greater than the upper limit value.

The analysis control means is operable to control means for performing an operation of selecting (separating) an ion according to mass (hereinafter referred to as "ion mass separation (or selection) operation"), an operation of inducing fragmentation of an ion (hereinafter referred to as "ion fragmentation operation") and others to allow an ion having a mass corresponding to the peak sorted by the peak sorting means to be selected as a precursor ion so as to perform the MS/MS analysis. Specifically, for example, the analysis control means is operable to control a voltage to be applied to each electrode of a three-dimensional quadrupole ion trap to sort an ion having a target mass, and then excite the ion so as to cause collision with a gas introduced into the ion trap to induce fragmentation of the ion by means of collision-induced dissociation.

In cases where a plurality of peaks are sorted by the peak sorting means, it may be arbitrarily determined in what order ions corresponding to the respective peaks are selected as precursor ions so as to perform the MS/MS analysis. For example, the ions may be selected in descending or ascending order of peak intensity or in descending or ascending order of ion mass.

The setting means may be configured to allow a user to directly input and set an intensity range having upper and lower thresholds of the signal intensity, in place of the lower limit value and the upper limit value of the signal intensity. Although each of the values may be designated by an absolute value of the signal intensity (ion intensity), it can be appropriately modified. For example, each of the values may be a relative value with respect to a base peak serving as a reference, or the upper limit value may be set as a relative value with respect to the lower limit value.

As above, in the mass spectrometry apparatus according to the first aspect of the present invention, an upper limit of the signal intensity can be set as a condition for sorting peaks on an $MS^{n-1}$ spectrum, as well as a lower limit. Thus, even an ion exhibiting a relatively low peak intensity can be subjected to the $MS^n$ analysis with high priority by adequately setting the upper limit, e.g., at a value less than that of a high-intensity peak which is known and therefore has no need for the $MS^n$ analysis. This makes it possible, e.g., in a liquid chromatography/mass spectrometry system, to create a highly-accurate $MS^n$ spectrum even for a target component having a relatively low concentration, and provide the $MS^n$ spectrum for identification and structural analysis of the component.

In conventional mass spectrometry apparatuses, an $MS^2$ analysis for a component exhibiting a relatively high peak intensity can also be avoided by registering a known component onto an exclusion list so as not to perform the $MS^2$ analysis for such a component. However, when the number of such components is large, it is cumbersome and complicated to register the components onto the exclusion list one by one. Moreover, there is a restriction on the number of components registerable onto the exclusion list. In contrast, in the mass spectrometry apparatus according to the first aspect of the present invention, a large number of components each exhibiting a peak intensity greater than the upper limit value can be excluded once for all by adequately setting the upper limit value. This makes it possible to significantly simplify the operation and reduce operational errors.

In the mass spectrometry apparatus according to the second aspect of the present invention, the setting means is operable, for example, to accept a lower limit of the signal intensity input by a user and set the lower limit for the peak sorting means. The peak sorting means is operable, for example, to exclude any peak exhibiting a peak intensity less than the lower limit value, from a plurality of peaks appearing in an MS spectrum. Then, the analysis control means is operable to control an operation, for example, of an ion trap in such a manner as to allow ions having respective masses corresponding to the peaks sorted by the peak sorting means to be selected as precursor ions in ascending order of peak intensity so as to perform the $MS^n$ analysis.

Thus, the mass spectrometry apparatus according to the second aspect of the present invention can subject an ion exhibiting a relatively low peak intensity to the $MS^n$ analysis by priority. Thus, for example, in a liquid chromatography/mass spectrometry system, even a target component having a relatively low concentration can be subjected to the $MS^n$ analysis during a period where it is still eluted off of a chromatography column, to create a highly accurate $MS^n$ spectrum.

BRIEF DESCRIPTION OF THE DRAWINGS

FIGS. 2A to 2C are explanatory diagrams of an automatic $MS^n$ function, wherein FIG. 2A shows a total ion chromatogram, and FIGS. 2B and 2C show an $MS^1$ spectrum and an $MS^2$ spectrum, respectively.

DETAILED DESCRIPTION OF THE EXEMPLARY EMBODIMENTS

Figure 1:
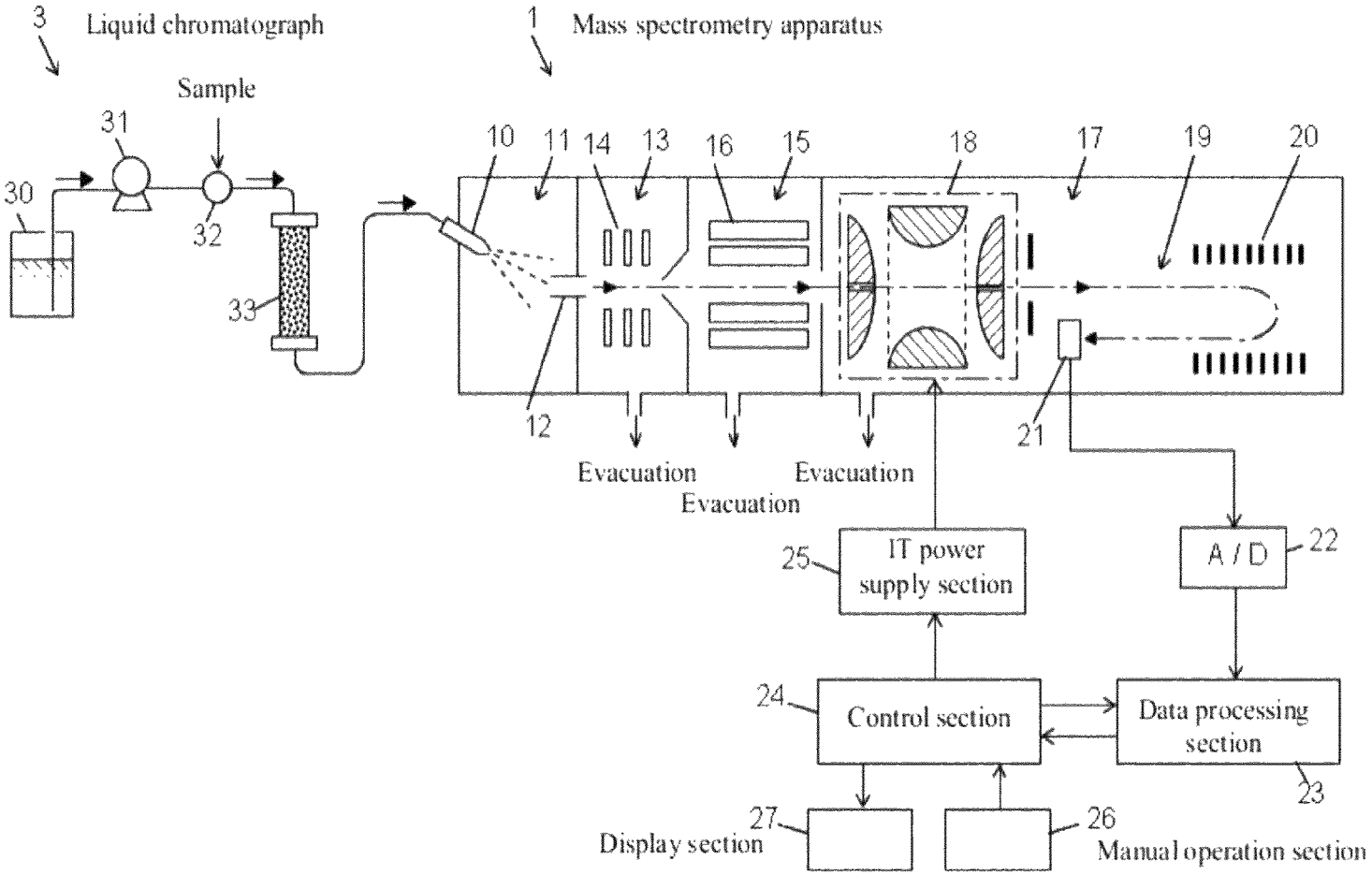
FIG. 1 is a schematic block diagram generally showing a liquid chromatography/mass spectrometry system including a mass spectrometry apparatus according to one embodiment of the present invention.

With reference to the drawings, a mass spectrometry apparatus of the present invention will now be described based on one embodiment thereof. FIG. 1 is a schematic block diagram generally showing a liquid chromatography/mass spectrometry system including a mass spectrometry apparatus according to one embodiment of the present invention.

In a liquid chromatograph (LC) 3 arranged in a preceding stage of the mass spectrometry apparatus 1, a mobile phase stored in a mobile-phase container 30 is sucked and fed to a column 33 at an approximately constant flow rate by a liquid feed pump 31. A target sample to be analyzed is introduced from an injector 32 into the mobile phase at a given timing, and sent to the column 33 together with the mobile phase. During passing through the column 33, various components of the sample are separated in a temporal direction, and eluted off of the column 33 in sequence. This sample liquid containing the eluted sample components is introduced to the mass spectrometry apparatus 1.

The sample liquid is sprayed from an electrospray nozzle 10 into an ionization chamber 11 having an approximately atmospheric atmosphere. Through the spraying, component molecules in the sample liquid are ionized, and the produced ions are sent to a first intermediate chamber 13 having a low vacuum atmosphere, through a heating pipe 12. In the ionization chamber 11, atmospheric pressure ionization, such as atmospheric pressure chemical ionization, may be employed in place of or in combination with the electrospray ionization. In either case, the ions are sent to a second intermediate chamber 15 having a medium vacuum atmosphere while being converged by a first ion lens 14 disposed inside the first intermediate chamber 13, and then sent to an analysis chamber 17 having a high vacuum atmosphere while being converged by a second ion lens 16 disposed inside the second intermediate chamber 15.

In the analysis chamber 17, the ions are temporarily accumulated, or subjected to an ion mass separation (selection) operation and an ion fragmentation operation on case-by-case basis. Then, all the ions are simultaneously ejected from the ion trap 18 at a given timing, and introduced to a time-of-flight mass separator 19. An ion manipulation in the ion trap 18 is controlled by a voltage to be applied from an IT power supply section 25 to each electrode (end cap electrodes and a ring electrode).

The time-of-flight mass separator 19 is a reflectron type having a reflectron 20 for reflecting ions by an electrostatic field. The ions are separated according to mass (specifically mass-to-charge ratio m/z) during a course of flying while turning back, wherein an ion having a smaller mass reaches an ion detector 21 at an earlier timing. For example, the ion detector 21 is composed of a combination of a conversion diode for converting an ion into an electron, and a secondary electron multiplier, and operable to output a detection signal indicative of a quantity of reached ions. This detection signal is converted into a digital value through an A/D converter 22, and the digital value is input into a dater processing section 23. The data processing section 23 is operable to create a mass spectrum, a mass chromatograph and a total ion chromatogram, and perform a qualitative analysis and a quantitative analysis based thereon.

A control section 24 is provided for controlling each of the above sections to perform the mass analysis operations. A manual operation section 26, such as a keyboard or a mouse, and a display section 27, such as an LCD display, are connected to the control section 24. For example, the data processing section 23 and the control section 24 may be materialized by a personal computer. In this case, a dedicated control/processing program installed on the personal computer is executed to allow the functions of the data processing section 23 and the control section 24 to be exerted.

In the mass spectrometry apparatus 1, the ion trap 18 can be controlled to simply accumulate and eject ions so as to perform a normal MS analysis. The ion trap 18 can also be controlled to perform an ion mass selection operation and an ion fragmentation operation based on collision-induced dissociation (CID), once, so as to perform an $MS^n$ analysis. In order to induce the collision-induced dissociation, a collision gas, such as Ar gas, is supplied from gas supply means (not shown) into the ion trap 18.

Figure 2A:
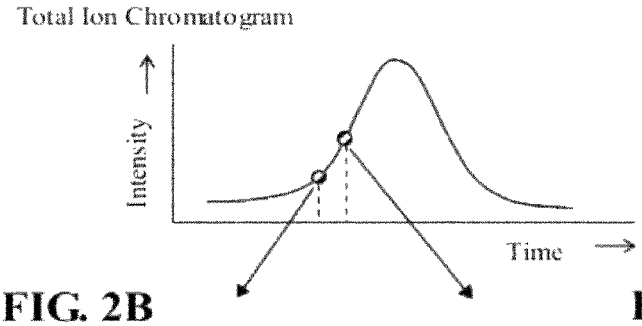
Figure 2B:
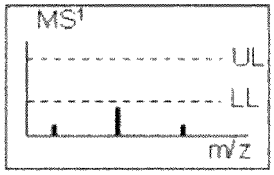
Figure 2C:
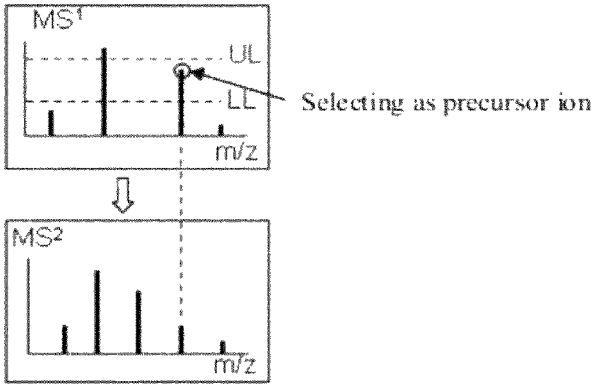

With reference to FIG. 2A to 2C, an automatic $MS^n$ function implementable in the liquid chromatography/mass spectrometry system will be briefly described below. FIG. 2A shows a total ion chromatogram to be created through an operation of the liquid chromatography/mass spectrometry (LCMS) system. In the total ion chromatogram, detection results (intensity values) of the entire ions are plotted along an elapsed time, irrespective of mass. Actually, an MS analysis is performed at given time intervals, and one mass spectrum ($MS^1$ spectrum) is created per MS analysis (see FIG. 2B).

In the automatic $MS^n$ function, it is determined whether respective peak intensities of peaks appearing on the $M^1$ spectrum meet a preset condition. If at least one of the peaks meets the condition, a specific ion corresponding to the peak is automatically selected as a precursor ion. Specifically, the ion trap 19 is controlled to perform the ion mass separation operation to select (i.e., selectively trap) the specific ion, and further perform the ion fragmentation operation to subject the selected ion to collision-induced dissociation. Then, various product ions resulting from the ion fragmentation operation are introduced to the time-of-flight mass separator 19, and detected by the ion detector 21 while being separated according to mass through the time-of-flight mass separator 19. The data processing section 23 is controlled to create an $MS^2$ spectrum (see FIG. 2C) based on a result of the detection. In the example illustrated in FIG. 2C, the number of precursor ions to be selected is one. However, if a plurality of peaks meet the preset condition, a plurality of ions will be selected as precursor ions. In this case, the precursor ions are selected in sequence, and $MS^2$ analyses for the respective precursor ions are performed to create $MS^2$ spectra.

Practically, the $MS^2$ analysis for the same precursor ion may be repeated appropriate designated times, and acquired mass profiles may be subjected to an integration processing to create an $MS^2$ spectrum having an enhanced S/N ratio.

As above, the automatic $MS^n$ function makes it possible to figure out a peak of a target component from a mass spectrum acquired around an elution time required for the target comportment to be eluted off of the column 33 after one sample injection into the LC 3, to automatically acquire an $MS^2$ spectrum which reflects a structure and composition of the target component.

Figure 3:
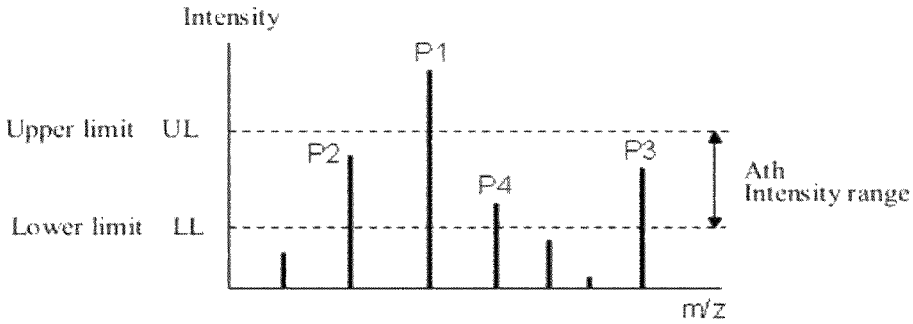
FIG. 3 is a graph showing one example of a peak sorting processing on a mass spectrum in the mass spectrometry apparatus according to the embodiment.

A feature of the mass spectrometry apparatus according to this embodiment is in a peak sorting processing which is performed in the data processing section 23 based on a mass spectrum during an analysis process according to the automatic $MS^n$ function. With reference to FIG. 3, this feature will be described below. In the analysis process according to the automatic $MS^n$ function, a user (analyst) is required to input a peak sorting condition through the manual operation section 26 in advance. As one example, this peak sorting condition may be defined by a pair of upper and lower limit values UL, LL of a signal intensity on an $MS^{n-1}$ spectrum (wherein UL>LL).

In response to the input of the upper and lower limit values UL, LL of the signal intensity, the control section 24 is operable to set an intensity range Ath for the data processing section 23, as the peak sorting condition to sort a peak intensity on a mass spectrum. Then, in response to creation of a mass spectrum during the LCMS analysis, the data processing section 23 is operable to determine whether respective peak intensities of a plurality of peaks appearing on the mass spectrum fall within the intensity range Ath, and sort a peak falling within the intensity range Ath, from the plurality of peaks. Given that a mass spectrum as shown in FIG. 3 is acquired at a certain time point, three peaks P2, P3, P4 each falling within the intensity range Ath are sorted.

In the conventional peak sorting condition defined by only a lower limit value of the signal intensity, a peak P1 having a maximum peak intensity is sorted together with the peaks P2, P3, P4. Differently, in the above peak sorting condition, the peak P1 is excluded, because the peak intensity thereof is greater than the upper limit value UL. Further, the remaining peaks other than peaks P1, P2, P3, P4 are also excluded, because a peak intensity of each of the remaining peaks is less than the lower limit LL. Consequently, the three peaks P2, P3, P4 are sorted, and ions having respective masses corresponding to the peaks P2, P3, P4 are subjected as precursor ions to an $MS^2$ analysis.

For example, in cases where a sample component exhibiting a certain level or more of intensity is known and therefore has no need for the $MS^2$ analysis, the upper limit value UL may be set in consideration of the intensity to prevent the unnecessary component from being subjected to the $MS^2$ analysis. Thus, for example, assuming that precursor ions are selected in descending order of peak intensity so as to perform the $MS^2$ analysis, the $MS^2$ analysis based on the conventional peak sorting processing is performed in the following order: P1→P2→P3→P4, i.e., the $MS^2$ analysis for the peak 4 is performed in the 4th cycle. Differently, the above peak sorting processing allows the $MS^2$ analysis for the peak 4 to be performed in the 3rd cycle, so that a waiting time can be reduced. In the situation where components sequentially eluted off of the column 33 of the LC 3 are analyzed, if a waiting time before the $MS^2$ analysis for a target component becomes longer, elution of the target component is likely to already be completed at a time when the $MS^2$ analysis becomes able to be performed for the target component. The above peak sorting processing capable of reducing a waiting time allows the $MS^2$ analysis for a target component to be performed during a period where the target component is still eluted off of the column 33, i.e., still introduced to the mass spectrometry apparatus 1. This makes it possible to acquire an excellent $MS^2$ spectrum even if the target component has a relatively low concentration.

Figure 4:
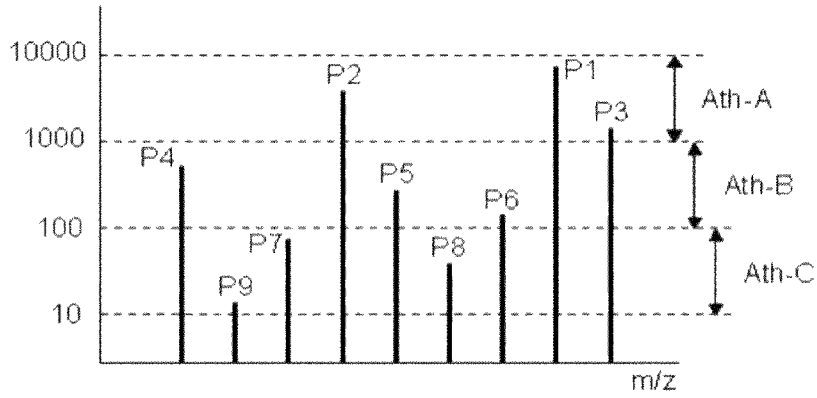
FIG. 4 is a graph showing another example of the peak sorting processing in the mass spectrometry apparatus according to the embodiment.

Another example of the peak sorting processing in the mass spectrometry apparatus 1 according to this embodiment will be described below. While the above peak sorting condition is defined by one pair of upper and lower limit values UL, LL of the signal intensity, it may be defined by plural pairs of upper and lower limit values UL, LL to be simultaneously set. FIG. 4 shows one example of this peak sorting condition, wherein three pairs of upper and lower limit values UL, LL are set (upper limit value UL: 10000/lower limit value LL: 1000; upper limit value UL: 1000/lower limit value LL: 100; and upper limit value UL: 100/lower limit value LL: 10). That is, three different intensity ranges Ath-A, Ath-B, Ath-C are defined by the three pairs of upper and lower limit values UL, LL.

Given that, in an operation of simultaneously analyzing nine components contained in a target sample, the nine components are eluted off at the same time, and a mass spectrum as shown in FIG. 4 is created as a result of an MS analysis thereof. For example, if precursor ions are selected in descending order of peak intensity under a condition of the intensity range Ath-A so as to perform an $MS^2$ analysis, the $MS^2$ analysis will be performed for respective ions corresponding to peaks P1, P2, P3 in the following order: P1→P2→P3. If precursor ions are selected in descending order of peak intensity under a condition of the intensity range Ath-B so as to perform an $MS^2$ analysis, the $MS^2$ analysis will be performed for respective ions corresponding to peaks P4, P5, P6 in the following order: P4→P5→P6. If precursor ions are selected in descending order of peak intensity under a condition of the intensity range Ath-C so as to perform an $MS^2$ analysis, the $MS^2$ analysis will be performed for respective ions corresponding to peaks P7, P8, P9 in the following order: P7→P8→P9.

As above, in cases where there are a large number of peaks, if adequate $MS^2$ spectra of three ions corresponding to the peaks falling within the intensity range Ath-C are created last after creating adequate $MS^2$ spectra of three ions corresponding to the peaks falling within the intensity range Ath-A, and adequate $MS^2$ spectra of three ions corresponding the peaks falling within the intensity range Ath-B, elution of target components as a source of the ions corresponding to the peaks falling within the intensity range Ath-C are likely to already be completed at a time when the $MS^2$ analysis becomes able to be performed for the target components. Thus, in order to improve an S/N ratio in each of the $MS^2$ spectra, instead of continuously repeating the $MS^2$ analysis for each of the three groups of ions, it is desirable to perform the $MS^2$ analysis in the following order: intensity range Ath-A→intensity range Ath-B→intensity range Ath-C, and repeat this operation while subjecting acquired profiles to an integration processing. It is understood that the $MS^2$ analysis may be performed in the following order: intensity range Ath-C→intensity range Ath-B→intensity range Ath-A. Further, the peak sorting condition may be arbitrarily set, for example, in such a manner that ions corresponding respective peaks falling within the intensity range Ath-B is excluded, and the $MS^2$ analysis is performed for only ions corresponding respective peaks falling within the intensity ranges Ath-A and Ath-C.

Further, the $MS^2$ analysis may be performed under a peak sorting condition using an intensity range which is changed depending on an elution time, based on a plurality of intensity ranges defined in the above manner. For example, if it is necessary to select both an ion of a major component (exhibiting a relatively high peak intensity) and an ion of a minor component (exhibiting a relatively low peak intensity), as precursor ions, in the conventional peak sorting condition defined by only an lower limit value of the signal intensity, the lower limit value has to be set to be reduced. In this case, the $MS^2$ analysis for a component inherently exhibiting a high signal intensity is undesirably started from a time when the signal intensity of the component is still relatively low. Thus, the $MS^2$ analysis for the component is likely to be completed at a time when the signal intensity of the component reaches an inherent peak top on a chromatogram. Fundamentally, in view of acquiring an $MS^2$ spectrum with enhanced quality, it is desirable that a precursor ion is subjected to fragmentation when a signal intensity thereof increases as high as possible.

Therefore, it is preferable that the $MS^2$ analysis for a target component is performed when a signal intensity of the component increases close to its inherent peak top on a chromatogram.

Figure 5:
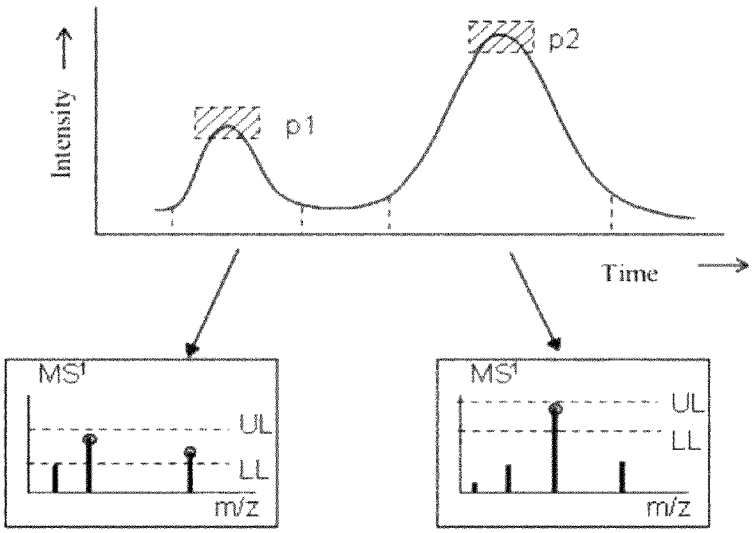
FIG. 5 is a graph showing still another example of the peak sorting processing in the mass spectrometry apparatus according to the embodiment.

Thus, in the mass spectrometry apparatus 1 according to this embodiment, it is desirable that an intensity range to be used as the peak sorting condition can be changed depending of the elution time (retention time), by utilizing the above function capable of pre-setting a plurality of different intensity ranges. For example, in cases where it is pre-verified or anticipated that a chromatogram as shown in FIG. 5 is acquired, the upper and lower limit values UL, LL defining a relatively low intensity range are set in an elution-time range around an elution time when a peak p1 having a relatively low peak top appears on a chromatogram, and the upper and lower limit values UL, LL defining a relatively high intensity range are set in an elution-time range around an elution time when a peak p2 having a relatively high peak top appears on the chromatogram. In this manner, an $MS^2$ analysis can be performed under a condition that, when each of the peaks p1, p2 reach an inherent peal top thereof on the chromatogram, respective peak tops on a mass spectrum are just located in corresponding ones of the intensity ranges. This makes it possible to acquire an $MS^2$ spectrum with further enhanced quality.

In the mass spectrometry apparatus according to the above embodiment, both the upper and lower limit values of the signal intensity are input and set as a condition for sorting a peak of a mass spectrum. Alternatively, an intensity range itself having upper and lower thresholds may be input and set. In the inputting/setting operation, the signal intensity may be input in the form of an absolute value. Alternatively, the upper and lower limit values may be designated by a relative value with respect to a base peak serving as a reference.

In the above case where the major component and the minor component exist together, the minor component may be subjected to an $MS^2$ analysis by priority so as to achieve an object of performing the $MS^2$ analysis for the minor component before completion of elution of the minor component. As one technique for the peak sorting processing, other than the above techniques, after excluding a peak having a peak intensity less than a lower threshold of the signal intensity, from a plurality of peaks, the remaining peaks are selected in ascending order of peak intensity as precursor ions so as to perform an $MS^2$ analysis. For example, in the mass spectrum illustrated in FIG. 3, this technique may be specifically configured to, after excluding peaks each having a peak intensity less than the lower limit value LL from the plurality of peaks appearing in the mass spectrum, select ions corresponding to respective ones of the remaining four peaks P1, P2, P3, P4 in ascending order of peak intensity, i.e., in the following order: P4→P3→P2→P1, as precursor ions, so as to perform an $MS^2$ analysis.

The above embodiment has been shown and described by way of example. It is to be understood that various changes and modifications will be apparent to those skilled in the art. Therefore, unless otherwise such changes and modifications depart from the scope of the present invention hereinafter defined, they should be construed as being included therein.

What is claimed is:

1. A mass spectrometry apparatus designed to determine one or more precursor ions based on an $MS^{n-1}$ spectral data acquired through an $MS^{n-1}$ analysis, and inducing fragmentation of the precursor ions to perform an $MS^n$ analysis (wherein n is an integer of 2 or more), the $MS^{n-1}$ spectral data including a plurality of peaks, comprising:

a) setting means operable to allow a user to input and set an upper limit and a lower limit value of a signal intensity on an $MS^{n-1}$ spectrum, or to directly input and set an intensity range having upper and lower thresholds of a signal intensity on an $MS^{n-1}$ spectrum;

b) peak sorting means operable to select and sort all peaks of the $MS^{n-1}$ spectral data having a peak intensity which falls within an intensity range defined by the upper and lower limit values or the directly input/set intensity range; and c) analysis control means operable to controllably allow an ion having a mass corresponding to the peak sorted by the peak sorting means to be selected as a precursor ion so as to perform the $MS^n$ analysis.

2. The mass spectrometry apparatus as defined in claim 1, which includes an ionization section, wherein the analysis is performed while sequentially introducing sample components separated in temporal direction by a chromatography column, into the ionization section.

3. A mass spectrometry apparatus designed to determine one or more precursor ions based on an $MS^{n-1}$ spectral data acquired through an $MS^{n-1}$ analysis, and inducing fragmentation of the precursor ions to perform an $MS^n$ analysis (wherein n is an integer of 2 or more), the $MS^{n-1}$ spectral data including a plurality of peaks, comprising:

a) setting means operable to allow a user to input and set at least a lower limit value of a signal intensity on an $MS^{n-1}$ spectrum;

b) peak sorting means operable to select and sort all peaks of the $MS^{n-1}$ spectral data having a peak intensity equal to or greater than the lower limit value; and c) analysis control means operable to controllably allow ions having respective masses corresponding to the peaks sorted by the peak sorting means to be selected as precursor ions in ascending order of peak intensity so as to perform the $MS^n$ analysis.

4. The mass spectrometry apparatus as defined in claim 3, which includes an ionization section, wherein the analysis is performed while sequentially introducing sample components separated in temporal direction by a chromatography column, into the ionization section.

* * * * *